US010620556B2

(12) United States Patent
Komatsu et al.

(10) Patent No.: US 10,620,556 B2
(45) Date of Patent: Apr. 14, 2020

(54) TONER

(71) Applicant: CANON KABUSHIKI KAISHA, Tokyo (JP)

(72) Inventors: Nozomu Komatsu, Toride (JP); Masayuki Hama, Toride (JP); Takeshi Hashimoto, Moriya (JP); Ichiro Kanno, Kashiwa (JP); Yuto Onozaki, Saitama (JP); Megumi Ikeda, Kashiwa (JP); Akifumi Matsubara, Narashino (JP); Hitoshi Sano, Matsudo (JP); Takakuni Kobori, Toride (JP); Hiroyuki Fujikawa, Yokohama (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 16/209,813

(22) Filed: Dec. 4, 2018

(65) Prior Publication Data

US 2019/0107791 A1 Apr. 11, 2019

Related U.S. Application Data

(63) Continuation of application No. PCT/JP2017/021270, filed on Jun. 8, 2017.

(30) Foreign Application Priority Data

Jun. 9, 2016 (JP) ..... 2016-115654

(51) Int. Cl.
*G03G 9/097* (2006.01)
*G03G 9/08* (2006.01)
*G03G 9/087* (2006.01)

(52) U.S. Cl.
CPC ..... *G03G 9/0819* (2013.01); *G03G 9/08* (2013.01); *G03G 9/0827* (2013.01); *G03G 9/08773* (2013.01)

(58) Field of Classification Search
CPC ..... G03G 9/09708; G03G 9/09725
See application file for complete search history.

(56) References Cited

U.S. PATENT DOCUMENTS

2012/0171602 A1* 7/2012 Yoon ..... G03G 9/0806 430/105
2012/0189851 A1* 7/2012 Zenitani ..... G03G 9/0812 428/404
2013/0065170 A1 3/2013 Kadokura
2014/0295340 A1 10/2014 Iida
2017/0227862 A1* 8/2017 Jin ..... G03G 9/08773

FOREIGN PATENT DOCUMENTS

| | | | |
|---|---|---|---|
| JP | 2004-102236 | A | 4/2004 |
| JP | 2006-30662 | A | 2/2006 |
| JP | 2006-251220 | A | 9/2006 |
| JP | 2009-85975 | A | 4/2009 |
| JP | 2012-128176 | A | 7/2012 |
| JP | 2012-149169 | A | 8/2012 |
| JP | 2012-149190 | A | 8/2012 |
| JP | 2012-163623 | A | 8/2012 |
| JP | 2013-242495 | A | 12/2013 |
| JP | 2014-149480 | A | 8/2014 |
| JP | 2015-125302 | A | 7/2015 |
| JP | 2015-218102 | A | 12/2015 |

* cited by examiner

*Primary Examiner* — Peter L Vajda
(74) *Attorney, Agent, or Firm* — Canon U.S.A. Inc., IP Division

(57) ABSTRACT

A toner having chargeability and fluidity that do not change to a great extent is provided. The toner includes toner particles containing a binder resin and includes inorganic fine particles A, wherein the shape factor SF-2 of primary particles of the inorganic fine particles A is 116 or less, and regarding the particle size distribution on a volume basis of the inorganic fine particles A on the toner particle surfaces, the particle diameter when a cumulative value from the small particle side reaches 16% by volume is denoted as D16, the particle diameter when a cumulative value reaches 50% by volume is denoted as D50, and the particle diameter when a cumulative value reaches 84% by volume is denoted as D84, D50 is 80 nm or more and 200 nm or less, and the particle size distribution indicator A represented by D84/D16 is 1.70 or more and 2.60 or less.

6 Claims, No Drawings

TONER

CROSS-REFERENCE TO RELATED APPLICATIONS

This application is a Continuation of International Patent Application No. PCT/JP2017/021270, filed Jun. 8, 2017, which claims the benefit of Japanese Patent Application No. 2016-115654, filed Jun. 9, 2016, both of which are hereby incorporated by reference herein in their entirety.

TECHNICAL FIELD

The present invention relates to a toner used for an image forming method of, for example, an electrophotographic system, an electrostatic recording system, an electrostatic printing system, or a toner printing system.

BACKGROUND ART

Toners have been required to deliver higher performance in accordance with widespread use of image forming apparatuses using toners, such as copiers and printers. In order to obtain high-quality images even when a large amount of images are output at high speed for a long time, it is required that the characteristics of the toner be stable. Specifically, regarding the toner, it is desired that a change in chargeability be small and that a change in fluidity be small even when high stress is applied to the toner.

To date, for the purpose of maintaining fluidity of a toner, a technology to add particles that have a large particle diameter and that can provide a spacer effect to a toner has been proposed. Japanese Patent Laid-Open No. 2012-149169 discloses a technology to maintain the fluidity of resin particle main bodies (toner particles) by adding silica particles in an odd form produced by a sol-gel method to the resin particle main bodies.

CITATION LIST

Patent Literature

PTL 1 Japanese Patent Laid-Open No. 2012-149169

When the toner to which silica particles in an odd form are added, as described in PTL 1, is used, the silica particles are not embedded into the toner particles to a great extent, even if a mechanical load is applied to the toner, and a change in the fluidity of the toner is suppressed.

However, the silica particles are in an odd form. Therefore, microscopic fluidity of the silica particles on the surfaces of the toner particles is reduced so as to cause a reduction in toner chargeability, and a change in the density (image density) of an output image may be increased.

SUMMARY OF INVENTION

It is an object of the present invention to provide a toner having chargeability and fluidity that do not change to a great extent.

The present invention provides a toner including toner particles containing a binder resin and including inorganic fine particles A, wherein the shape factor SF-2 of primary particles of the inorganic fine particles A is 116 or less, and regarding the particle size distribution on a volume basis of the inorganic fine particles A on the toner particle surfaces, the particle diameter when a cumulative value from the small particle side reaches 16% by volume is denoted as D16, the particle diameter when a cumulative value reaches 50% by volume is denoted as D50, and the particle diameter when a cumulative value reaches 84% by volume is denoted as D84, D50 is 80 nm or more and 200 nm or less, and the particle size distribution indicator A represented by D84/D16 is 1.70 or more and 2.60 or less.

Further features of the present invention will become apparent from the following description of exemplary embodiments.

DESCRIPTION OF EMBODIMENTS

In the present invention, the expressions "○○ or more and xx or less" and "○○ to xx" representing numerical ranges refer to numerical ranges including the lower limit and the upper limit as end points unless otherwise specified.

The form for realizing the present invention will be described below in detail.

A toner according to the present invention includes toner particles containing a binder resin and includes inorganic fine particles A, wherein the shape factor SF-2 of primary particles of the inorganic fine particles A is 116 or less, and regarding the particle size distribution on a volume basis of the inorganic fine particles A on the toner particle surfaces, the particle diameter when a cumulative value from the small particle side reaches 16% by volume is denoted as D16, the particle diameter when a cumulative value reaches 50% by volume is denoted as D50, and the particle diameter when a cumulative value reaches 84% by volume is denoted as D84, D50 is 80 nm or more and 200 nm or less, and the particle size distribution indicator A represented by D84/D16 is 1.70 or more and 2.60 or less.

As described above, the particle size distribution indicator A in the present invention indicates the value of D84/D16.

The toner according to the present invention is a highly durable toner, the chargeability is stable, and a change in the fluidity is small after long-term use. Therefore, high-quality images can be output stably.

The present inventors conjectured that the above-described problems were addressed for the following reasons.

In order to enhance the durability of a toner even when high stress is applied to the toner, it is necessary that the inorganic fine particles A be attached to protrusion portions of toner particle surfaces to which the inorganic fine particles A serving as external additives are not readily attached. In addition, it is necessary to suppress the inorganic fine particles A serving as external additives from embedding into the toner particle surfaces.

The inorganic fine particles A according to the present invention have broad particle size distribution on a volume basis compared with inorganic fine particles having a large particle diameter in the related art. In the present invention, the expression "particle size distribution" refers to particle size distribution on a volume basis unless otherwise specified. In general, when the particle size distribution of particles is broad, the particles tend to have a closest-packed state. Inorganic fine particles having a narrow particle size distribution and a large particle diameter readily roll on the toner particle surfaces and may localize and remain in the recessed portions so as to reduce a spacer effect (effect of spacer particles). On the other hand, when the particle size distribution is broad, each inorganic fine particle having a large particle diameter can roll on a toner particle surface. However, inorganic fine particles are arranged close to each other, and movement is mutually restricted to some extent. As a result, inorganic fine particles are also readily present on the protrusion portions of the toner particles and do not significantly localize. Therefore, the spacer effect is maintained.

In this regard, when the particle size distribution is narrow, the heights of inorganic fine particles having a large particle diameter from the toner particle surfaces become almost equal. Consequently, when stress is continuously applied to the toner in a developing apparatus or the like, inorganic fine particles having a large particle diameter on the toner particle surfaces are uniformly loaded and are therefore uniformly embedded into the toner particles. On the other hand, when the particle size distribution is broad, there are variations in heights of the inorganic fine particles having a large particle diameter from the toner particle surfaces. At the initial stage of use, higher (larger particle diameter) inorganic fine particles are subjected to the stress and exert the spacer effect. At this time, lower (small particle diameter) inorganic fine particles can be present under no stress. That is, differences occur in the timing of embedding into the toner particles and, therefore, the spacer effect is maintained for a long time.

Further, the inorganic fine particles A of the toner according to the present invention have high microscopic fluidity because the shape of the primary particles is substantially spherical or spherical. Therefore, as described above, the inorganic fine particles having a large particle diameter can move in the state in which the movement on the toner particle surfaces is restricted to some extent, and stable chargeability can be maintained.

Consequently, even when stress is continuously applied to the toner according to the present invention in a developing apparatus or the like, inorganic fine particles having a large particle diameter are not readily embedded into the toner particle surfaces and, therefore, the spacer effect is maintained. As a result, the chargeability and the fluidity are maintained.

Regarding the inorganic fine particles A of the toner according to the present invention, the shape factor SF-2 of primary particles is 116 or less, preferably 113 or less, and more preferably 110 or less. As described above, the inorganic fine particles A of the toner according to the present invention are spherical or substantially spherical. Consequently, the fluidity on the toner particle surfaces is excellent. If the shape factor SF-2 is more than 116, microscopic fluidity is reduced. Therefore, the spacer effect tends to be reduced because the chargeability of the toner is readily degraded and uniform dispersion on the toner particle surfaces does not readily occur.

Regarding the particle size distribution on a volume basis of the inorganic fine particles A according to the present invention on the toner particle surfaces, the particle diameter D50 when a cumulative value from the small particle side reaches 50% by volume is 80 nm or more and 200 nm or less, preferably 80 nm or more and 180 nm or less, and more preferably 80 nm or more and 150 nm or less. If D50 is less than 80 nm, the fluidity of the toner can be ensured at the initial stage of use, but the inorganic fine particles serving as the external additives are readily embedded into the toner particles after long-term use because the spacer effect is not sufficiently obtained. As a result, the fluidity of the toner is readily significantly changed, uniform chargeability is not readily obtained, and a stable image density is not readily obtained. If D50 is more than 200 nm, the particle diameter is excessively large, and uniform attachment to the toner particle surfaces is not readily performed. As a result, sufficient fluidity of the toner is not obtained.

The particle size distribution indicator A of the inorganic fine particles A of the toner particles according to the present invention is 1.70 or more and 2.60 or less, preferably 1.80 or more and 2.50 or less, and more preferably 1.90 or more and 2.40 or less. When the particle size distribution indicator A is within the above-described range, the inorganic fine particles can be densely present on the toner particle surfaces and, therefore, movement is mutually restricted to some extent. As a result, inorganic fine particles are also readily present on the protrusion portions of the toner particles and do not significantly localize. Consequently, the spacer effect is maintained. If particle size distribution indicator A is less than 1.70, the particle size distribution becomes narrow, and the inorganic fine particles readily roll on the toner particle surfaces and may localize and remain in the recessed portions. As a result, the spacer effect (effect of spacer particles) may be reduced. If the particle size distribution indicator A is more than 2.60, coarse particles in the inorganic fine particles increase, uniform dispersion does not readily occur on the toner particle surfaces, and the spacer effect is readily reduced.

The particle size distribution indicator B represented by D84/D50 of the inorganic fine particles A of the toner particles according to the present invention is preferably 1.20 or more and 1.60 or less, more preferably 1.25 or more and 1.50 or less, and further preferably 1.30 or more and 1.40 or less.

As described above, the inorganic fine particles B in the present invention denotes the value of D84/D50. An increase in the particle size distribution indicator B indicates that the large particle diameter side is broader than the small particle diameter side. When the particle size distribution indicator B is within the above-described range, the microscopic fluidity of the inorganic fine particles is enhanced, and the fluidity of the toner can be maintained at a higher level.

The degree of consolidation of the inorganic fine particles A of the toner according to the present invention is preferably 1.05 g/cm$^3$ or more, more preferably 1.20 g/cm$^3$ or more, and further preferably 1.30 g/cm$^3$ or more. The degree of consolidation in the present invention is a density measured under application of 10 MPa. The measuring method will be described later in detail. When the degree of consolidation is within the above-described range, the inorganic fine particles become dense, and the inorganic fine particles are more firmly arranged on the toner particle surfaces. Consequently, even when high stress is applied to the toner, the stress is subjected to in-plane dispersion (dispersed in a planar direction) and, thereby, the inorganic fine particles are not readily embedded into the toner particle surfaces.

In the present invention, a preferable configuration of the toner will be described below in detail.

Binder Resin

Examples of binder resins used for the toner particles of the toner according to the present invention include polymers described below.

Monopolymers of styrene or substitution products thereof, e.g., polystyrene, poly-p-chlorostyrene, and polyvinyl toluene Styrene-based copolymers, e.g., styrene-p-chlorostyrene copolymers, styrene-vinyl toluene copolymers, styrene-vinyl naphthalene copolymers, styrene-acrylic acid ester copolymers, styrene-methacrylic acid ester copolymers, styrene-methyl α-chloromethacrylate copolymers, styrene-acrylonitrile copolymers, styrene-vinyl methyl ether copolymers, styrene-vinyl ethyl ether copolymers, styrene-vinyl methyl ketone copolymers, and styrene-acrylonitrile-indene copolymers Polyvinyl chlorides, phenolic resins, natural modified phenolic resins, natural resin-modified maleic resins, acrylic resins, methacrylic resins, polyvinyl acetates, silicone resins, polyesters, polyurethanes, polyamides, furan resins, epoxy resins, xylene resins, polyvinyl butyrals, terpene resins, coumarone-indene resins, and petroleum resins In particular, it is preferable that polyesters be used from the viewpoint of low-temperature fixability and chargeability of the toner.

Wax

The toner particles of the toner according to the present invention may contain wax. Examples of wax include the following.

Hydrocarbon-based waxes, e.g., low-molecular-weight polyethylenes, low-molecular-weight polypropylenes, alkylene copolymers, microcrystalline wax, paraffin wax, and Fischer-Tropsch wax Oxides of a hydrocarbon-based wax, for example, polyethylene oxide wax, or block copolymers thereof Waxes containing a fatty acid ester as a primary component, for example, carnauba wax Waxes produced by deacidifying some or all fatty acid esters, for example, deacidified carnauba wax In particular, from the viewpoint of low-temperature fixability and hot offset resistance of the toner, hydrocarbon-based waxes, e.g., paraffin wax and Fischer-Tropsch wax, and a fatty acid ester-based wax, for example, carnauba wax, are preferable.

In the present invention, from the viewpoint of hot offset resistance of the toner, a hydrocarbon-based wax is more preferable.

The wax content in the toner particles is preferably 1.0 parts by mass or more and 20.0 parts by mass or less relative to 100 parts by mass of the binder resin in the toner particles. When the wax content is within the above-described range, the hot offset resistance at high temperature is further improved.

Meanwhile, from the viewpoint of satisfying both storage stability and hot offset resistance of the toner, it is preferable that the peak temperature of the maximum endothermic peak of the toner satisfy the following.

That is, on an endothermic curve during a temperature increase based on measurement by using a differential scanning calorimeter (DSC), the peak temperature of the maximum endothermic peak present in the temperature range of 30° C. or higher and 200° C. or lower is preferably 50° C. or higher and 110° C. or lower.

Colorant

The toner particles of the toner according to the present invention may contain a colorant. Regarding the colorant, known yellow colorant, magenta colorant, cyan colorant, and black colorant may be used.

Examples of black colorants include carbon black and a colorant in a tone of black adjusted by using a yellow colorant, a magenta colorant, and a cyan colorant.

Regarding the colorant, pigment or dye may be used alone, or dye and pigment may be used in combination.

The colorant content in the toner particles is preferably 0.1 parts by mass or more and 30.0 parts by mass or less relative to 100 parts by mass of the binder resin in the toner particles.

Magnetic Material

The toner according to the present invention may be a magnetic toner or a nonmagnetic toner. When a magnetic toner is used, it is preferable that magnetic iron oxide be used as the magnetic material included in the toner particles. Examples of a magnetic iron oxide include magnetite, maghematite, and ferrite.

The magnetic material content in the toner particles is preferably 25 parts by mass or more and 95 parts by mass or less and more preferably 30 parts by mass or more and 45 parts by mass or less relative to 100 parts by mass of the binder resin in the toner particles.

Charge Control Agent

The toner particles of the toner according to the present invention may contain a charge control agent. Examples of the charge control agent include negative charge control agents and positive charge control agents.

Examples of the negative charge control agents include salicylic acid metal compounds, naphthoic acid metal compounds, dicarboxylic acid metal compounds, polymer-type compounds having sulfonic acid or carboxylic acid in a side chain, polymer-type compounds having a sulfonate or sulfonic acid esterified product in a side chain, polymer-type compounds having a carboxylate or a carboxylic acid esterified product in a side chain, boron compounds, urea compounds, silicon compounds, and calixarenes.

When the charge control agent is included in the toner particles, the charge control agent may be internally added or externally added to the toner particles.

The charge control agent content in the toner particles is preferably 0.2 parts by mass or more and 10.0 parts by mass or less relative to 100 parts by mass of the binder resin in the toner particles.

Inorganic Fine Particles A

The toner according to the present invention contains inorganic fine particles A.

Examples of the inorganic fine particles A include fine particles of a metal oxide, e.g., silicon oxide (silica), aluminum oxide (alumina), titanium oxide (titania), magnesium oxide, zirconium oxide, chromium oxide, cerium oxide, tin oxide, and zinc oxide. In addition, examples of the inorganic fine particles A include fine particles of, for example, amorphous carbon (carbon black and the like), nitrides (silicon nitride and the like), carbides (silicon carbide and the like), and metal salts (strontium titanate, calcium sulfate, barium sulfate, calcium carbonate, and the like).

Regarding the toner according to the present invention, the above-described inorganic fine particles may be used alone as the inorganic fine particles A, or a plurality of types may be used in combination. Meanwhile, the inorganic fine particles A of the toner according to the present invention may be fine particles of a complex composed of a plurality of metal oxides.

In the present invention, the inorganic fine particles A are preferably silica fine particles. The silica fine particles have high resistance. Therefore, the resistance of the toner increases, charge relaxation in a high-temperature high-humidity (H/H) environment is suppressed, and the charge-increasing property of the toner is excellent.

Examples of the method for manufacturing the silica fine particles include methods described below.

A flame fusion method in which a silicon compound is made into a gaseous state and decomposed and fused in flame.

A vapor phase method in which silicon tetrachloride is burned with a mixed gas of oxygen, hydrogen, and a diluent gas (for example, nitrogen, argon, or carbon dioxide) at high temperature (dry-process silica, fumed silica).

A wet method in which, in an organic solvent that contains water, alkoxysilane is hydrolyzed by using a catalyst, a condensation reaction is performed, the solvent is removed from the resulting silica sol suspension liquid, and drying is performed (sol-gel silica).

In addition, a method in which the silica fine particles obtained by the above-described manufacturing method are subjected to classification treatment and/or disintegration treatment so as to produce silica fine particles having a predetermined volume average particle diameter may be adopted. The volume average particle diameter is an average particle diameter on a volume basis.

The inorganic fine particles A of the toner according to the present invention are more preferably inorganic fine particles produced by the vapor phase method or the flame fusion method because of having higher resistance and being resilient to humidity among the silica fine particles. When the inorganic fine particles produced by the vapor phase method or the flame fusion method are used, the volume average particle diameter of primary particles and the particle size distribution on a volume basis of the silica fine particles can be controlled by the raw material gas feed rate, the amount of flammable gas supplied, and/or the oxygen ratio.

In the present invention, in order to adjust the particle size distribution on a volume basis to be within a predetermined range, the method for manufacturing the silica fine particles is particularly preferably the flame fusion method. The silica fine particles produced by the flame fusion method have a feature of being relatively independent of each other. In addition, the particle size distribution on a volume basis of the silica fine particles can be adjusted to become broad. The silica fine particles produced by the sol-gel method tend to have a narrow particle size distribution on a volume basis.

It is preferable that the surfaces of the inorganic fine particles A of the toner according to the present invention be hydrophobized by surface treatment. When the surfaces are hydrophobized, moisture absorption of the silica fine particles is suppressed, the chargeability of the toner is enhanced, charging is also readily performed after a durability use, and a stable image density is readily obtained.

Examples of the surface treatment include silane coupling treatment, oil treatment, fluorine treatment, and surface treatment for forming an alumina coating. A plurality of types of surface treatment may be used in combination, and the order of these treatments may be appropriately selected.

More preferably, the inorganic fine particles A of the toner according to the present invention are surface-treated by using hexamethyldisilazane serving as a surface treatment agent.

Examples of the method for surface-treating inorganic fine particles by a silane coupling agent include the following methods.

A dry method in which a vaporized silane coupling agent reacts with inorganic fine particles that have been made into an aerosol state by agitation.

A wet method in which inorganic fine particles are dispersed into a solvent, and a silane coupling agent is added by dropping so as to cause a reaction.

Examples of oils for the oil treatment of the inorganic fine particles include silicone oils, fluorine oils, and various modified oils. More specific examples include dimethyl silicone oil, alkyl-modified silicone oil, α-methylstyrene-modified silicone oil, chlorophenylsilicone oil, and fluorine-modified silicone oil.

The silicone oil has a viscosity of preferably 50 to 500 $mm^2/s$ at 25° C. The amount of oil used for the oil treatment is preferably 1 part by mass or more and 35 parts by mass or less relative to 100 parts by mass of original inorganic fine particles (inorganic fine particles before treatment).

The content of the inorganic fine particles A in the toner according to the present invention is preferably 0.5 parts by mass or more and 15.0 parts by mass or less relative to 100 parts by mass of the binder resin included in the toner particles, more preferably 0.8 parts by mass or more and 10.0 parts by mass or less, and further preferably 1.0 parts by mass or more and 8.0 parts by mass or less. When the content of the inorganic fine particles A is within the above-described range, the chargeability of the toner is further stabilized, and a change in the fluidity is further reduced.

The true density of the inorganic fine particles A of the toner according to the present invention is preferably 2.0 $g/cm^3$ or more, and more preferably 2.2 $g/cm^3$ or more.

In the present invention, the coverage of the toner particle surfaces by the inorganic fine particles A is preferably 15% or more and 45% or less, and more preferably 20% or more and 35% or less. When the coverage is within the above-described range, the amount of the inorganic fine particles attached to the toner particle surfaces becomes more appropriate, and the chargeability of the toner is further stabilized. The above-described coverage can be adjusted by controlling the amount of the inorganic fine particles A added and the mixing time of the toner particles and the inorganic fine particles A.

The inorganic fine particles A of the toner according to the present invention has preferably one peak in the particle size distribution on a volume basis. If a plurality of types of inorganic fine particles having different average particle diameters are used in combination as the inorganic fine particles A, the chargeability or the aggregation property tends to be different on a type of the inorganic fine particles constituting the inorganic fine particles A basis. Consequently, the inorganic fine particles A may be unevenly attached to the toner particle surfaces or be present while localizing on a type of the inorganic fine particles constituting the inorganic fine particles A basis. For example, inorganic fine particles having small particle diameters have strong electrostatic adhesive force and strong non-electrostatic adhesiveness. Therefore, when the toner particles and the inorganic fine particles A are mixed, inorganic fine particles constituting the inorganic fine particles A and having small particle diameters tend to attach to the toner particle surfaces before inorganic fine particles having large particle diameters. As a result, the inorganic fine particles having large particle diameters and having a large spacer effect have to attach to the inorganic fine particles having small particle diameters that have attached to the toner particle surfaces. In such a case, the inorganic fine particles having large particle diameters tend to be unevenly present on the toner particle surfaces, and the spacer effect (effect of spacer particles) is readily degraded due to long-term use.

Other External Additives

In order to improve the fluidity of the toner and adjust the amount of triboelectric charge, an external additive other than the inorganic fine particles A may be added to the toner according to the present invention.

It is preferable that the external additive other than the inorganic fine particles A be inorganic fine particles of silicon oxide (silica), aluminum oxide (alumina), titanium oxide (titania), strontium titanate, calcium carbonate, and the like.

Examples of external additives other than the inorganic fine particles include resin fine particles of a vinyl resin, a polyester, a silicone resin, and the like.

The inorganic fine particles and the resin fine particles function as auxiliaries for controlling the chargeability of the toner, the fluidity, and the cleaning.

Mixing of Toner Particles and External Additive (Including Inorganic Fine Particles A)

Regarding mixing of the toner particles and the external additive, for example, known mixers, such as a Henschel mixer, a double cone mixer, a V-type mixer, a drum-type mixer, a super mixer, a Nauta Mixer, and MECHANO HYBRID (produced by NIPPON COKE & ENGINEERING CO., LTD.) can be used.

Carrier

It is preferable that the toner according to the present invention be used as a two-component developer by being mixed with a magnetic carrier from the viewpoint of obtaining an image that is stable for a long time.

Regarding the magnetic carrier, known magnetic carriers, for example, an iron powder with oxidized surfaces or an unoxidized iron powder, metal particles of iron, lithium, calcium, magnesium, nickel, copper, zinc, cobalt, manganese, or rare earth, alloy particles thereof, or oxide particles thereof, magnetic particles, e.g., ferrite, and magnetic-material-dispersed resin carrier (so-called resin carrier) containing magnetic particles and a binder resin that holds the magnetic particles in a dispersed state, may be used.

Method for Manufacturing Toner Particles

The toner particles according to the present invention can be produced by a known method for manufacturing toner particles, for example, a fusion kneading method, an emulsion aggregation method, and a dissolution suspension method.

Next, a method for measuring each physical property related to the present invention will be described.

Method for Measuring Shape Factor SF-2 of Inorganic Fine Particles A on Toner Particle Surfaces, Method for Measuring Particle Size of Inorganic Fine Particles A, and Method for Calculating Particle Size Distribution Indicators A and B In the present invention, the shape factor SF-2 of the inorganic fine particles A on the toner particle surfaces and the particle size on a volume basis of the inorganic fine particles A were calculated as described below. Initially, a toner particle surface image was photographed at a magnification of 30,000 times by using an ultra-high resolution field emission scanning electron microscope (trade name: S-4800) produced by Hitachi High-Technologies Corporation. Subsequently, the photographed surface image was analyzed by image analysis software (trade name: Image-Pro Plus ver. 5.0) produced by NIPPON ROPER K.K., and, thereby, the shape factor SF-2 of the inorganic fine particles A and the particle size on a volume basis of the inorganic fine particles A were calculated.

Regarding a particle of the toner, 100 inorganic fine particles A on the toner particle surface were observed by the above-described SEM apparatus. The shape factor SF-2 was calculated by introducing the above-described image into an image analyzer (trade name: Luzex III) produced by NIRECO CORPORATION through an interface, performing analysis, and performing calculation on the basis of the following formula. The same operation was performed with respect to inorganic fine particles A on the surfaces of 10 toner particles, an average value of them was determined and denoted as shape factor SF-2.

$$\text{shape factor SF-2}=100\times L^2/(4\times \text{AREA}\times\pi)$$

(in the above-described formula, L represents the circumference of an inorganic fine particle A, and AREA represents the projected area of an inorganic fine particle A)

Regarding the particle size on a volume basis of the inorganic fine particles A, the particle diameter when a cumulative value from the small particle side reached 16% by volume was denoted as D16, the particle diameter when a cumulative value reached 50% by volume was denoted as D50, and the particle diameter when a cumulative value reached 84% by volume was denoted as D84 on the basis of the cumulative frequency of equivalent circle diameter in the resulting image. The same operation was performed with respect to inorganic fine particles A on the surfaces of 10 toner particles, and an average value of each particle diameter was determined. Each of the particle size distribution indicator A: D84/D16 and the particle size distribution indicator B: D84/D50 was calculated from the resulting values.

Method for Measuring Degree of Consolidation of Inorganic Fine Particles A

The degree of consolidation of the inorganic fine particles A was measured by using a rectangular tablet forming machine having a cross-sectional area of 381 $mm^2$. After 1.50 g of inorganic fine particles A were placed into a forming portion, and a pressure of 10 MPa was applied for 10 seconds by using a pressing machine. Just after the pressure was released, the thickness of the sample was measured by using a micrometer. The same measurement was performed 3 times, an average value was assumed to be the thickness of the sample, and the degree of consolidation was calculated.

Method for Measuring True Density of Inorganic Fine Particles A

The true density of the inorganic fine particles A was measured by using a dry-process automatic pycnometer AccuPic 1330 (produced by SHIMADZU CORPORATION).

Initially, 1 g of sample that had been left to stand for 24 hours in an environment at 23° C./50% RH was precisely weighed and was placed into a measurement cell (10 $cm^3$). The measurement cell was inserted into a main body sample chamber. Regarding the measurement, automatic measurement was performed by inputting the mass (weight) of the sample into the main body and starting the measurement. Regarding the measurement condition of the automatic measurement, helium gas adjusted at 20.000 psig ($2.392\times10^2$ kPa) was used. After purging inside the sample chamber 10 times, helium gas purging was repeated until an equilibrium state was reached where the equilibrium state was set to be the state in which a pressure change in the sample chamber was 0.005 psig/min ($3.447\times10^{-2}$ kPa/min). The pressure in the main body sample chamber at the equilibrium state was measured. The sample volume was calculated on the basis of the pressure change when the equilibrium state was reached.

The sample volume was calculated, and the true density of the sample was calculated on the basis of the following formula.

$$\text{sample true density (g/cm}^3\text{)}=\text{sample mass (g)/sample volume (cm}^3\text{)}$$

The automatic measurement was repeated 5 times, and the average value of the measured values was assumed to be the true density ($g/cm^3$) of the inorganic fine particles A.

Measurement of Coverage of Toner Particle Surfaces by Inorganic Fine Particles A The coverage was calculated by analyzing a toner particle surface image photographed by using Hitachi ultra-high resolution field emission scanning electron microscope S-4800 (Hitachi High-Technologies Corporation) by image analysis software Image-Pro Plus ver. 5.0 (NIPPON ROPER K.K.). The image photographing conditions of S-4800 were as described below.

(1) Sample Production

A sample stage (aluminum sample stage of 15 mm×6 mm) was lightly coated with a conductive paste, and a toner was blown thereon. Further, air blowing was performed so as to remove an excessive toner from the sample stage and to perform drying sufficiently. The sample stage was set on a sample holder, and the height of the sample stage was adjusted to 36 mm by a sample height gauge.

(2) S-4800 Observation Condition Setting

The coverage was calculated by using an image obtained on the basis of S-4800 backscattered electron image observation. Regarding the backscattered electron image, charge up of inorganic fine particles A was less than the secondary electron image and, therefore, the coverage could be measured with good accuracy.

Liquid nitrogen was poured into an anticontamination trap attached to a casing of S-4800 so as to overflow and S-4800 was left to stand for 30 minutes. "PC-SEM" of S-4800 was started, and flushing (cleaning of FE chip serving as an electron source) was performed. An accelerating voltage display portion of a control panel on a screen was clicked, a "Flushing" button was pushed so as to open a flushing execution dialog box. It was checked that the flushing strength was 2, and the flushing was executed. It was checked that the emission current by the flushing was 20 to 40 μA. The sample holder was inserted into a sample chamber of the casing of S-4800. "Starting point" on the control panel was pushed so as to move the sample holder to an observation position.

The accelerating voltage display portion was clicked so as to open an HV setting dialog box, the accelerating voltage was set to be [0.8 kV], and the emission current was set to be [20 μA]. In a tab "Base" of the operation panel, signal selection was set to be "SE", regarding an SE detector, "Up (U)" and "+BSE" were selected, and "L. A. 100" was selected in a right selection box of "+BSE" so as to select the mode in which a backscattered electron image was observed. In addition, in the tab "Base" of the operation panel, probe current in electron optical system condition block was set to be "Normal", focus mode was set to be [UHR], and WD was set to be [3.0 mm]. "ON" button in the accelerating voltage display portion of the control panel was pushed so as to apply an accelerating voltage.

(3) Focusing

A focus knob "COARSE" of the operation panel was adjusted, and when focusing was performed to some extent, aperture alignment was adjusted. "Align" of the control panel was clicked so as to display an alignment dialog box, and "Beam" was selected. The STIGMA/ALIGNMENT knobs (X,Y) were adjusted so as to move a displayed beam to the center of concentric circles. Subsequently, "Aperture" was selected, the STIGMA/ALIGNMENT knobs (X,Y) were adjusted one by one so as to stop movement of the image or minimize movement of the image. The aperture dialog box was closed, and focusing was performed automatically. Thereafter, the magnification was set to be 10,000 (10 k) times, focusing was performed by using the focus knob and the STIGMA/ALIGNMENT knobs, as described above, and focusing was performed again automatically. This operation was repeated again so as to perform focusing. In this regard, if the inclination angle of an observation surface is large, the measurement accuracy of the coverage tends to be degraded. Therefore, an observation surface in which the surface was hardly inclined was selected by selecting the observation surface, the entirety of which was focused at the same time, when focusing was performed, and analysis was performed. Regarding a toner (toner particle) to be photographed, a toner particle was selected such that the maximum length (Lt) of the toner (toner particle) was within the range of $0.8 \times Dv \leq Lt \leq 1.2 \times Dv$. This is for the purpose of using an average toner having a diameter close to the volume average particle diameter (Dv).

(4) Image Saving

The brightness was adjusted in ABC mode, and photographing and saving were performed at a size of 640×480 pixels. The resulting image file was used and the following analysis was performed. A photograph per particle of the toner was taken, and images of at least 100 particles of the toner were obtained.

(5) Image Analysis

In the present invention, the following analysis software was used, and the surface coverage was calculated by performing image processing of the images obtained by the above-described method.

The analysis condition of the image analysis software Image-Pro Plus ver. 5.0 was as described below.

Software Image-Pro Plus 5.1J

When a background in the photograph is not the surface of the toner (toner particle), only the surface portion of the toner (toner particle) was set to be AOI (Area of Interest) and the following analysis was performed. AOI could be demarcated by selecting a free form AOI button from the AOI tool and drawing a closed curve so as to trace the outline of the surface portion of the toner (toner particle). In a tool bar, "Measure" and "Count/Size" were selected in this order, and "Automatic bright objects" was selected in a column "Intensity Range Selection". An 8-Connect was selected among the object extraction options, and Smoothing was set to be 0. In addition, Pre-Filter, Fill Holes, and Convex Hull were not selected, "Clean Borders" was set to be "None". In the tool bar, "Select Measurements" was selected from "Measure", and Filter Ranges of Area was set to be 2 to 107. "Count" was pushed and the inorganic fine particles A were extracted.

When it appeared that inorganic fine particles A were connected to each other, the following operation was performed in advance.

"Measure" and "Count/Size" were selected in this order, and Split Objects command was selected. If "Auto" in a trace dialog box had been checked, the check mark was deleted. A cursor was put on outside the connected particles, a left click was made, a division line was drawn crossing the connection portion, a left click was made, and a right click was made. OK button in Split Objects dialog box was pushed so as to finish the split. On the image, the object No. of a fine particle that was not the object of analysis was double-clicked. In Object Attributes window opened, "Hide" was selected. This operation was repeated and, thereby, only fine particles that were the objects of analysis were extracted.

The coverage was determined from the total sum (P) of areas of inorganic fine particles A that were extracted as the objects and the surface area (S) of the toner (toner particle) that was specified as AOI by calculation using the following formula.

$$\text{coverage } (\%) = (P/S) \times 100$$

The same operation was repeated with respect to 100 toners (toner particle), and an average value of the coverage was determined.

Measurement of Volume Average Particle Diameter (Dv) of Toner

The volume average particle diameter (Dv) of the toner was calculated by using an accurate particle size distribution analyzer (trade name: Coulter Counter Multisizer 3, produced by Beckman Coulter, Inc.), where an electrical sensing zone method was utilized and a 100 μm aperture tube was provided, and an attached dedicated software (trade name: Beckman Coulter Multisizer 3 Version 3.51, produced by Beckman Coulter, Inc.) for setting of the measurement condition and analysis of the measurement data, performing the measurement under the condition of the number of effective measurement channels of 25,000, and analyzing the measurement data. Regarding an electrolytic aqueous solution used for the measurement, a solution in which analytical grade sodium chloride was dissolved into deionized water so as to have a concentration of about 1% by mass (trade name: ISOTON II, produced by Beckman Coulter, Inc.) was used.

EXAMPLES

The present invention will be described below in more detail with reference to the examples.

Production Example of Binder Resin

Production Example of Polyester Resin

Polyoxypropylene(2.2)-2,2-bis(4-hydroxyphenyl)propane: 100.0% by mole

Terephthalic acid: 80.0% by mole relative to total number of moles of polyvalent carboxylic acid Trimellitic anhydride: 20.0% by mole relative to total number of moles of polyvalent carboxylic acid The above-described monomer materials were placed into a reaction vessel provided with a cooling pipe, an agitator, a nitrogen introduction tube, and a thermocouple. Subsequently, 1.5 parts by mass of tin 2-ethylhexanoate serving as a catalyst (esterification catalyst) relative to 100 parts by mass of the total amount of the above-described monomer materials was added. Thereafter, the inside of the reaction vessel was substituted with nitrogen gas, the temperature was gradually increased under agitation, and a reaction was performed for 2 hours under agitation at a temperature of 200° C.

Further, the pressure in the reaction vessel was reduced to 8.3 kPa and maintained for 1 hour. Thereafter, cooling to 180° C. was performed, a reaction was performed without doing anything else, and the temperature was decreased after it was ascertained that the softening temperature measured in accordance with ASTM D36-86 reached 122° C. so as to stop the reaction.

The softening temperature (Tm) of the resulting polyester resin was 112° C. and the glass transition temperature (Tg) was 63° C.

Production Example of Inorganic Fine Particles

Production Example of Silica Fine Particles 1

In production of silica fine particles 1, a hydrocarbon-oxygen mixed type burner having a double pipe structure that could form inner flame and outer flame was used for a combustion furnace. This burner had a configuration in which a two-fluid nozzle for injecting a slurry was installed on a central portion of the burner, and a silicon compound serving as a raw material was introduced. In the configuration, a hydrocarbon-oxygen flammable gas was injected from the surroundings of the two-fluid nozzle so as to form inner flame that was a reducing atmosphere and outer flame. The atmosphere, the temperature, the flame length, and the like could be adjusted by controlling the amounts and the flow rates of the flammable gas and oxygen. In the flame, silica fine particles were generated from the silicon compound serving as the raw material and, in addition, the silica fine particles could be fused so as to have a predetermined particle diameter. Thereafter, cooling was performed, and the resulting silica fine particles were collected by a bag filter or the like so as to obtain silica fine particles having a predetermined particle diameter.

The silica fine particles were produced by using hexamethylcyclotrisiloxane as the raw material silicon compound. Subsequently, surface treatment was performed by using 4% by mass of hexamethyldisilazane relative to 100 parts by mass of the resulting silica fine particles so as to obtain silica fine particles 1.

Production Examples of Silica Fine Particles 3 to 14

Silica fine particles 3 to 14 were obtained by adjusting the production condition for the above-described silica fine particles 1.

Table 1 shows the physical properties of the toners using the resulting silica fine particles 1 and 3 to 14. The silica fine particles 1 and 3 to 14 correspond to the inorganic fine particles A according to the present invention.

Production Example of Silica Fine Particles 2

Surface treatment was performed by using 4% by mass of hexamethyldisilazane relative to 100 parts by mass of silica fine particles produced by a sol-gel method so as to obtain silica fine particles 2.

Table 1 shows the physical properties of the toner using the resulting silica fine particles 2. The silica fine particles 2 do not correspond to the inorganic fine particles A according to the present invention.

Example 1

Production Example of Toner 1

Polyester resin 1: 100.0 parts by mass 3,5-Di-t-butylsalicylic acid aluminum compound: 0.5 parts by mass Fischer-Tropsch wax (peak temperature of maximum endothermic peak: 90° C.): 5.0 parts by mass C.I. Pigment Blue 15: 35.0 parts by mass The above-described materials were mixed by using a Henschel mixer (trade name: Model FM-75J, produced by Mitsui Miike Chemical Engineering Machinery Co., Ltd.) under the condition of the number of revolutions of 20 $s^{-1}$ and the rotation time of 5 minutes and, thereafter, kneaded by a twin screw extruder (trade name: Model PCM-30, produced by Ikegai Corporation) set at a temperature of 125° C. The resulting kneaded material was cooled and coarsely crushed to 1 mm or less by a hammer mill so as to obtain a coarse product. The resulting coarse product was pulverized by a mechanical pulverizer (trade name: T-250, produced by Turbo Kogyo Co., Ltd.). Further, classification was performed by using a rotary classifier (trade name: 200TSP, produced by Hosokawa Micron Corporation) so as to obtain toner particles. Regarding the operation condition of the rotary classifier (trade name: 200TSP, produced by Hosokawa Micron Corporation), the number of revolutions of a classification rotor was set to be 50.0 $s^{-1}$.

The volume average particle diameter (Dv) of the resulting toner particles was 6.2 μm.

Toner 1 was obtained by adding 1.0 parts by mass of hydrophobic silica fine particles that had an average primary particle diameter of 15 nm and that was surface-treated by 20.0% by mass of hexamethyldisilazane and 5.0 parts by mass of silica fine particles 1 described above to 100.0 parts by mass of the resulting toner particles, performing mixing by the Henschel mixer (trade name: Model FM-75J, produced by Mitsui Miike Chemical Engineering Machinery Co., Ltd.), and passing the resulting mixture through an ultrasonic vibration sieve having an aperture of 54 μm.

The resulting toner 1 had an endothermic peak derived from a wax component at 90° C. on a DSC curve based on differential scanning calorimetry.

Toner 1 described above and a magnetic carrier were mixed by using V type blender (trade name: Model V-10, produced by TOKUJU CORPORATION) under the condition of 0.5 $s^{-1}$ and 5 minutes such that the toner concentration became 9% by mass. The magnetic carrier used was magnetic ferrite carrier particles (number average particle diameter: 35 μm) with surfaces covered by an acrylic resin.

Two-component developer 1 was obtained as described above.

Two-component developer 1 was used, and the evaluations described later were performed. The evaluation results are shown in Table 2.

Comparative Example 1 and Examples 2 to 14

Toners 2 to 15 were produced and two-component developers 2 to 15 were further produced in the same manner as example 1 except that silica fine particles 1 were changed as shown in Table 1.

The resulting two-component developers 2 to 15 were used, and the same evaluations as in example 1 were performed. The evaluation results are shown in Table 2.

Evaluation

A modified machine of a full-color copier (trade name: imagePRESS C10000VP) produced by CANON KABUSHIKI KAISHA was used as an image forming apparatus, two-component developer 1 was placed into a developing device of a cyan station, and the evaluation was performed.

An image output durability test of 300,000 sheets was performed in each of normal-temperature normal-humidity environment (23° C./50% RH) and high-temperature high-humidity environment (30° C./80% RH). Thereafter, evaluations were performed by the following methods.

In this regard, during the durability test, the paper was made to run under the same development condition and transfer condition (where no calibration was performed) as the first sheet. The printing rate of the output image was set to be 1%, and the development bias was adjusted such that the initial image density was set to be 1.55. Regarding the paper for evaluation, A4 sized normal paper (trade name: CF-0081, basis weight of 81.4 g/$m^2$, sold by Canon Marketing Japan Inc.) for copier was used.

Evaluation 1: Evaluation of Image Density

Regarding the evaluation of an image density, after the above-described durability test, a solid image was output on the entire surfaces of 3 sheets of A3 sized paper, and the image on the third sheet was used for the evaluation. SpectroDensitometer (trade name: 500 Series) produced by X-Rite, Inc., was used, the density of the output image was measured at 5 points, the average value of the 5 points was assumed to be the image density, and rating was performed on the basis of the following criteria. A change in the chargeability of the toner had an influence on the image density. Therefore, the stability (smallness of the change) of the toner chargeability could be evaluated on the basis of the present evaluation. As the image density maintenance factor described below increased, the stability of the toner chargeability was enhanced (a change in the chargeability was a small extent).

A: the image density maintenance factor after the durability test was 90% or more relative to the initial image density of 1.55

B: the image density maintenance factor after the durability test was 80% or more and less than 90% relative to the initial image density of 1.55

C: the image density maintenance factor after the durability test was 70% or more and less than 80% relative to the initial image density of 1.55

D: the image density maintenance factor after the durability test was less than 70% relative to the initial image density of 1.55

Evaluation 2: Dot Reproducibility (Roughness)

Regarding the evaluation of dot reproducibility, after the above-described durability test, a dot image in which one pixel was formed by one dot was output on the entire surfaces of 3 sheets of A3 sized paper, and the image on the third sheet was used for the evaluation. In this regard, when a dot image was output, the spot diameter of a laser beam was adjusted such that the area per dot on the paper was set to be 20,000 $\mu m^2$ or more and 25,000 $\mu m^2$ or less. A digital microscope (trade name: VHX-500, lens of wide range zoom lens VH-Z100) was used, and the area of each of 1,000 dots was measured. The number average area (S) and the standard deviation of the areas (σ) of 1,000 dots were calculated, and the dot reproducibility index was calculated on the basis of the following formula. A change in the fluidity of the toner had an influence on the dot reproducibility. Therefore, the smallness of the change in the toner fluidity could be evaluated on the basis of the present evaluation. As the value I described below decreased, the change in the fluidity of the toner was reduced.

$$\text{dot reproducibility index } (I) = \sigma / S \times 100$$

A: I was less than 4.0

B: I was 4.0 or more and less than 6.0

C: I was 6.0 or more and less than 8.0

D: I was 8.0 or more

TABLE 1

| Toner No. | Inorganic fine particles | Amount of addition | Inorganic fine particles | Amount of addition | Method for producing inorganic fine particles | SF-2 | Particle diameter on volume basis of inorganic fine particles on toner particle surface D16 [nm] | D50 [nm] | D84 [nm] | Number of peaks in particle size distribution of inorganic fine particles | Particle size distribution indicator A D84/D16 | Particle size distribution indicator B D84/D50 | Degree of consolidation [g/cm³] | True density [g/cm³] | Coverage by inorganic fine [%] |
|---|---|---|---|---|---|---|---|---|---|---|---|---|---|---|---|
| Toner 1 | silica fine particles 1 | 5.0 | — | — | flame fusion method | 106 | 79 | 116 | 156 | 1 | 1.97 | 1.34 | 1.33 | 2.2 | 30 |

TABLE 1-continued

| Toner No. | Inorganic fine particles | Amount of addition | Inorganic fine particles | Amount of addition | Method for producing inorganic fine particles | SF-2 | Particle diameter on volume basis of inorganic fine particles on toner particle surface D16 [nm] | D50 [nm] | D84 [nm] | Number of peaks in particle size distribution of inorganic fine particles | Particle size distribution indicator A D84/D16 | Particle size distribution indicator B D84/D50 | Degree of consolidation [g/cm$^3$] | True density [g/cm$^3$] | Coverage by inorganic fine [%] |
|---|---|---|---|---|---|---|---|---|---|---|---|---|---|---|---|
| Toner 2 | silica fine particles 2 | 5.0 | — | — | sol-gel method | 110 | 78 | 113 | 129 | 1 | 1.65 | 1.14 | 1.04 | 1.8 | 18 |
| Toner 3 | silica fine particles 3 | 5.0 | — | — | flame fusion method | 113 | 75 | 119 | 162 | 1 | 2.16 | 1.36 | 1.26 | 2.2 | 31 |
| Toner 4 | silica fine particles 4 | 5.0 | — | — | flame fusion method | 116 | 70 | 122 | 168 | 1 | 2.40 | 1.38 | 1.19 | 2.2 | 31 |
| Toner 5 | silica fine particles 5 | 5.0 | — | — | flame fusion method | 104 | 51 | 80 | 111 | 1 | 2.18 | 1.39 | 1.35 | 2.2 | 35 |
| Toner 6 | silica fine particles 6 | 5.0 | — | — | flame fusion method | 106 | 99 | 150 | 199 | 1 | 2.01 | 1.33 | 1.34 | 2.2 | 28 |
| Toner 7 | silica fine particles 7 | 5.0 | — | — | flame fusion method | 110 | 116 | 180 | 247 | 1 | 2.13 | 1.37 | 1.35 | 2.2 | 27 |
| Toner 8 | silica fine particles 8 | 5.0 | — | — | flame fusion method | 111 | 130 | 200 | 279 | 1 | 2.15 | 1.40 | 1.35 | 2.2 | 22 |
| Toner 9 | silica fine particles 9 | 5.0 | — | — | flame fusion method | 106 | 80 | 120 | 152 | 1 | 1.90 | 1.27 | 1.30 | 2.2 | 26 |
| Toner 10 | silica fine particles 10 | 5.0 | — | — | flame fusion method | 106 | 81 | 121 | 146 | 1 | 1.80 | 1.21 | 1.20 | 2.2 | 20 |
| Toner 11 | silica fine particles 11 | 5.0 | — | — | flame fusion method | 106 | 81 | 120 | 138 | 1 | 1.70 | 1.15 | 1.05 | 2.2 | 18 |
| Toner 12 | silica fine particles 12 | 5.0 | — | — | flame fusion method | 106 | 70 | 120 | 175 | 1 | 2.50 | 1.46 | 1.38 | 2.2 | 33 |
| Toner 13 | silica fine particles 13 | 5.0 | — | — | flame fusion method | 106 | 73 | 121 | 190 | 1 | 2.60 | 1.57 | 1.40 | 2.2 | 35 |
| Toner 14 | silica fine particles 14 | 5.0 | — | — | flame fusion method | 106 | 77 | 122 | 200 | 1 | 2.60 | 1.64 | 1.41 | 2.2 | 37 |
| Toner 15 | silica fine particles 5 | 2.5 | silica fine particles 8 | 2.5 | flame fusion method | 107 | 82 | 138 | 213 | 2 | 2.60 | 1.54 | 1.37 | 2.2 | 33 |

TABLE 2

| | | Image density | | | | Dot reproducibility | | | |
|---|---|---|---|---|---|---|---|---|---|
| | | In normal-temperature normal-humidity environment (NN) | | In high-temperature high-humidity (HH) | | In normal-temperature normal-humidity environment (NN) | | In high-temperature high-humidity environment (HH) | |
| Evaluation result | Toner No. | Image density maintenance factor [%] | Rank | Image density maintenance factor [%] | Rank | Dot reproducibility index (I) | Rank | Dot reproducibility index (I) | Rank |
| Example 1 | Toner 1 | 98 | A | 96 | A | 1.3 | A | 1.4 | A |
| Comparative example 1 | Toner 2 | 73 | C | 66 | D | 7.4 | C | 8.5 | D |
| Example 2 | Toner 3 | 96 | A | 92 | A | 1.8 | A | 2.0 | A |
| Example 3 | Toner 4 | 94 | A | 88 | B | 2.2 | A | 2.4 | A |
| Example 4 | Toner 5 | 90 | A | 92 | A | 1.5 | A | 1.8 | A |
| Example 5 | Toner 6 | 97 | A | 94 | A | 1.5 | A | 1.6 | A |

TABLE 2-continued

| | | Image density | | | | Dot reproducibility | | | |
|---|---|---|---|---|---|---|---|---|---|
| | | In normal-temperature normal-humidity environment (NN) | | In high-temperature high-humidity (HH) | | In normal-temperature normal-humidity environment (NN) | | In high-temperature high-humidity environment (HH) | |
| Evaluation result | Toner No. | Image density maintenance factor [%] | Rank | Image density maintenance factor [%] | Rank | Dot reproducibility index (I) | Rank | Dot reproducibility index (I) | Rank |
| Example 6 | Toner 7 | 97 | A | 93 | A | 2.2 | A | 2.5 | A |
| Example 7 | Toner 8 | 96 | A | 91 | A | 2.6 | A | 2.9 | A |
| Example 8 | Toner 9 | 92 | A | 89 | B | 2.8 | A | 3.0 | A |
| Example 9 | Toner 10 | 90 | A | 86 | B | 3.5 | A | 3.8 | A |
| Example 10 | Toner 11 | 86 | B | 82 | B | 4.1 | B | 4.6 | B |
| Example 11 | Toner 12 | 89 | B | 85 | B | 3.3 | A | 3.5 | A |
| Example 12 | Toner 13 | 88 | B | 83 | B | 3.8 | A | 4.0 | B |
| Example 13 | Toner 14 | 86 | B | 80 | B | 4.2 | B | 4.6 | B |
| Example 14 | Toner 15 | 83 | B | 78 | C | 4.5 | B | 5.1 | B |

According to the present invention, a toner having chargeability and fluidity that do not change to a great extent is provided.

The present invention is not limited to the above-described embodiment and can be variously changed and modified without departing from the spirit and scope of the invention. Therefore, to apprise the public of the scope of the present invention, the following claims are appended.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

The invention claimed is:

1. A toner comprising toner particles containing a binder resin and comprising inorganic fine particles A, wherein the shape factor SF-2 of primary particles of the inorganic fine particles A is 116 or less, and regarding the particle size distribution on a volume basis of the inorganic fine particles A on the toner particle surfaces, the particle diameter when a cumulative value from the small particle side reaches 16% by volume is denoted as D16, the particle diameter when a cumulative value reaches 50% by volume is denoted as D50, and the particle diameter when a cumulative value reaches 84% by volume is denoted as D84, D50 is 80 nm or more and 200 nm or less, and the particle size distribution indicator A represented by D84/D16 is 1.97 or more and 2.18 or less.

2. The toner according to claim 1, wherein the particle size distribution indicator B represented by D84/D50 is 1.20 or more and 1.60 or less.

3. The toner according to claim 1, wherein the degree of consolidation of the inorganic fine particles A is 1.05 $g/cm^3$ or more.

4. The toner according to claim 1, wherein the true density of the inorganic fine particles A is 2.0 $g/cm^3$ or more.

5. The toner according to claim 1, wherein the inorganic fine particles A are silica fine particles.

6. The toner according to claim 1, wherein one peak is present in the particle size distribution.

* * * * *